US011196175B2

(12) United States Patent
Sakamoto et al.

(10) Patent No.: US 11,196,175 B2
(45) Date of Patent: Dec. 7, 2021

(54) ANTENNA DEVICE

(71) Applicant: MITSUBISHI ELECTRIC CORPORATION, Tokyo (JP)

(72) Inventors: Hiroaki Sakamoto, Tokyo (JP); Takashi Yanagi, Tokyo (JP); Yusuke Kitsukawa, Tokyo (JP); Moriyasu Miyazaki, Tokyo (JP); Takuma Kadoya, Tokyo (JP); Yuichi Hagito, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 15 days.

(21) Appl. No.: 16/646,030

(22) PCT Filed: Sep. 29, 2017

(86) PCT No.: PCT/JP2017/035396

§ 371 (c)(1),
(2) Date: Mar. 10, 2020

(87) PCT Pub. No.: WO2019/064470

PCT Pub. Date: Apr. 4, 2019

(65) Prior Publication Data

US 2020/0274251 A1 Aug. 27, 2020

(51) Int. Cl.
*H01Q 21/00* (2006.01)
*H01Q 1/48* (2006.01)
(Continued)

(52) U.S. Cl.
CPC ..... *H01Q 21/0006* (2013.01); *H01Q 1/48* (2013.01); *H01Q 9/42* (2013.01); *H01Q 21/24* (2013.01)

(58) Field of Classification Search
CPC ..... H01Q 1/38–1/48; H01Q 9/0407; H01Q 9/42; H01Q 21/00; H01Q 21/24
See application file for complete search history.

(56) References Cited

U.S. PATENT DOCUMENTS 5,497,164 A * 3/1996 Croq ..... H01Q 9/0414 343/700 MS
6,320,542 B1 * 11/2001 Yamamoto ..... H01Q 1/38 343/700 MS
(Continued)

FOREIGN PATENT DOCUMENTS

JP 2000-77930 A 3/2000
JP 2014-135707 A 7/2014

*Primary Examiner* — Hasan Islam
(74) *Attorney, Agent, or Firm* — Birch, Stewart, Kolasch & Birch, LLP

(57) ABSTRACT

Included are: a coaxial line (10) provided so as to pass through a second ground conductor (6), a first dielectric substrate (8), and a second dielectric substrate (9), the coaxial line (10) including an outer conductor (11) allowing a first ground conductor (1), a second ground conductor (6), and a third ground conductor (7) to be conductive therea-mong; and a conductive member (15) provided so as to pass through the first dielectric substrate (8), the conductive member (15) allowing the first ground conductor (1) and the second ground conductor (6) to be conductive therebetween. An interface circuit (18) combines a plurality of signals having mutually different phases output from each of plurality of element antennas (3*a*), (3*b*), (3*c*), and (3*d*) and outputs the combined signal to the coaxial line (10).

12 Claims, 9 Drawing Sheets

(51) Int. Cl.
*H01Q 9/42* (2006.01)
*H01Q 21/24* (2006.01)

(56) References Cited

U.S. PATENT DOCUMENTS

| | | | | |
|---|---|---|---|---|
| 6,639,558 | B2 * | 10/2003 | Kellerman | H01Q 9/0414 343/700 MS |
| 8,842,045 | B2 * | 9/2014 | Tatarnikov | H01Q 9/0414 343/700 MS |
| 2005/0162318 | A1 * | 7/2005 | Higasa | H01Q 9/0407 343/700 MS |

* cited by examiner

ANTENNA DEVICE

TECHNICAL FIELD

The present invention relates to an antenna device including a plurality of element antennas.

BACKGROUND ART

Some of terminals for receiving polarized waves transmitted from satellite telephone service or global positioning system (GPS) satellites use circularly polarized wave antennas in order to avoid a polarized wave loss from growing even when a terminal user moves.

Examples of circularly polarized wave antennas include spiral antennas and patch antennas. However, it is known that a circularly polarized wave antenna such as a spiral antenna is increased in size if an attempt is made to broaden the bandwidth of the antenna.

Moreover, for example when a polarized wave transmitted from a GPS satellite is reflected by the ground or a building, the polarized wave may be changed to reverse rotation.

In a case where the polarized wave transmitted from the GPS satellite is a right-handed circularly polarized wave (RHCP), the RHCP may change to a left-handed circularly polarized wave (LHCP).

It is known that when a circularly polarized wave antenna such as a spiral antenna is reduced in size, a back lobe, which is a cross polarized wave extending backward from the antenna, increases. In a case where the polarized wave transmitted from the GPS satellite is RHCP, a back lobe which is a cross polarized wave is LHCP.

For this reason, reducing the size of a circularly polarized wave antenna increases the possibility for the circularly polarized wave antenna to receive unwanted LHCPs, which may deteriorate the positioning performance based on polarized waves transmitted from the GPS satellites.

Since reducing the size of a circularly polarized wave antenna increases the possibility of receiving unnecessary back lobes, a large-sized circularly polarized wave antenna is generally used. In a case where it is highly desired to reducing the size of a circularly polarized wave antenna, however, reception of unnecessary back lobes may be suppressed by providing a large ground plate separately.

However, in a case where a large ground plate is provided separately, the entire antenna device including the circularly polarized wave antenna becomes larger.

Patent Literature 1 below discloses an antenna device in which reception of unnecessary back lobes is suppressed without separately providing a large ground plate.

The antenna device disclosed in Patent Literature 1 suppresses reception of unnecessary back lobes by providing a choke structure on the bottom surface of a radiation conductor.

The choke structure provided on the bottom surface of the radiation conductor has two conductor plates arranged in parallel, and the center portions of the two conductor plates are thicker than the edges of the two conductor plates.

By allowing the center portions of the two conductor plates and the edges of the two conductor plates to have different thicknesses, it becomes possible to adjust the electrical length of the choke structure depending on the frequency of an unnecessary back lobe.

CITATION LIST

Patent Literature

Patent Literature 1: JP 2014-135707 A

SUMMARY OF INVENTION

Technical Problem

Since a conventional antenna device is configured as described above, reception of unnecessary back lobes can be suppressed without providing a large ground plate separately.

However, since the choke structure provided instead of a large ground plate has a complicated structure in which the center portions of the two conductor plates and the edges of the two conductor plates have different thicknesses, producing the antenna devices is disadvantageously troublesome.

The present invention has been devised to solve the disadvantage as described above, and an object of the invention is to obtain an antenna device capable of adjusting the resonance frequency and suppressing reception of unnecessary back lobes without mounting a complicated choke structure.

Solution to Problem

An antenna device according to the present invention includes: a first ground conductor having a first plane and a second plane; a plurality of element antennas arranged on the first plane of the first ground conductor; a second ground conductor arranged on the second plane of the first ground conductor in parallel with the first ground conductor; a third ground conductor arranged in parallel to the second ground conductor on, of two planes of the second ground conductor, a plane opposite to the plane on which the first ground conductor is arranged; a first dielectric substrate arranged between the first ground conductor and the second ground conductor; a second dielectric substrate arranged between the second ground conductor and the third ground conductor; a coaxial line provided so as to pass through the second ground conductor and the first and second dielectric substrates, the coaxial line including an outer conductor allowing the first ground conductor, the second ground conductor, and the third ground conductor to be conductive thereamong; a conductive member provided so as to pass through the first dielectric substrate, the conductive member allowing the first ground conductor and the second ground conductor to be conductive therebetween; and an interface circuit for combining a plurality of signals having mutually different phases output from each of the plurality of element antennas and outputting the combined signal to the coaxial line.

Advantageous Effects of Invention

According to this invention, included are: a coaxial line provided so as to pass through a second ground conductor and first and second dielectric substrates, the coaxial line including an outer conductor allowing the first ground conductor, the second ground conductor, and the third ground conductor to be conductive thereamong; and a conductive member provided so as to pass through the first dielectric substrate, the conductive member allowing the first ground conductor and the second ground conductor to be conductive therebetween, and an interface circuit combines a plurality of signals having mutually different phases output from each of the plurality of element antennas and outputs the combined signal to the coaxial line. This allows the resonance frequency to be adjusted to suppress reception of unwanted back lobes without mounting a complicated choke structure.

DESCRIPTION OF EMBODIMENTS

To describe the present invention further in detail, embodiments for carrying out the present invention will be described below with reference to the accompanying drawings.

First Embodiment

Figure 1:
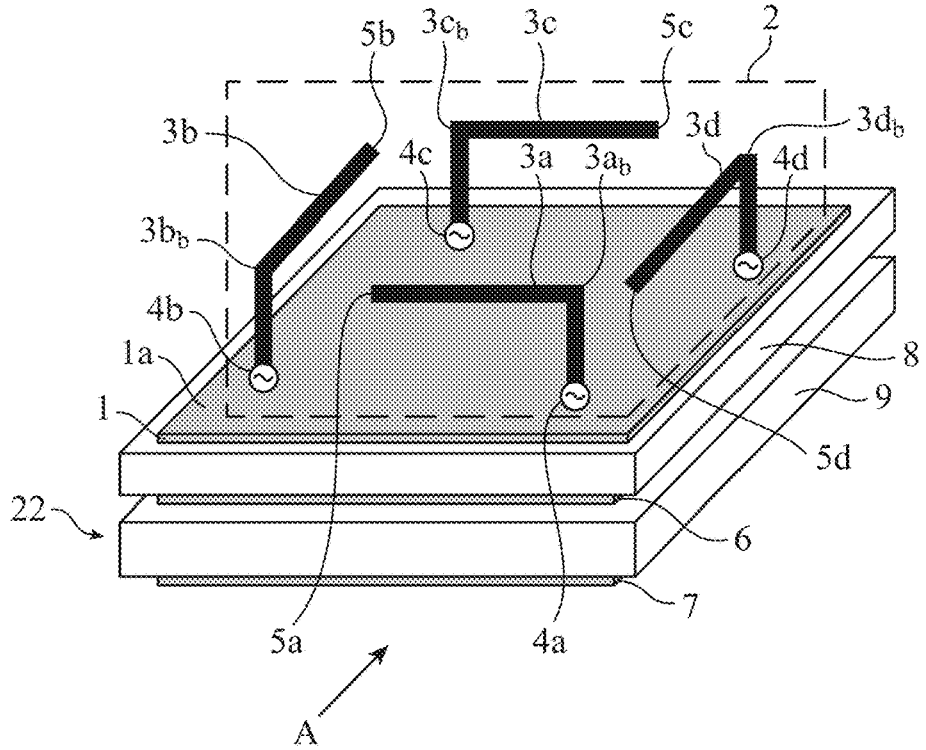
FIG. 1 is a perspective view illustrating an antenna device according to a first embodiment of the present invention.

FIG. 1 is a perspective view illustrating an antenna device according to a first embodiment of the present invention.

Figure 2:
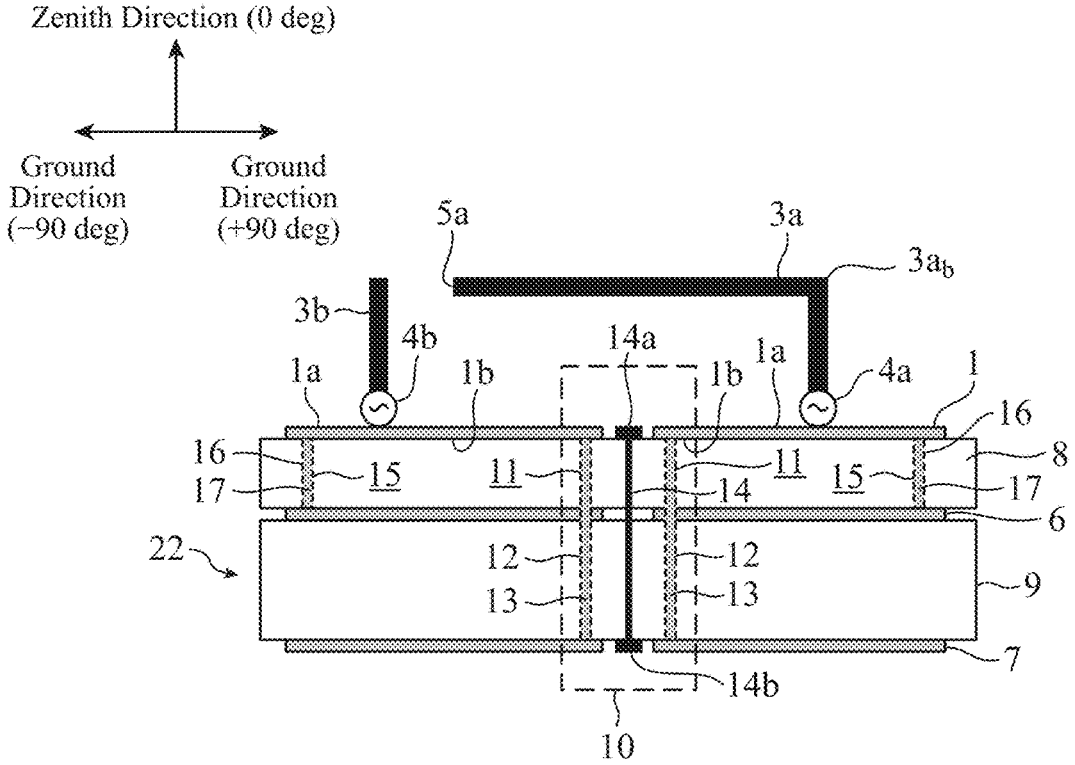
FIG. 2 is a cross-sectional side view of the antenna device of FIG. 1 as viewed from direction A.

FIG. 2 is a cross-sectional side view of the antenna device of FIG. 1 as viewed from direction A.

Figure 3:
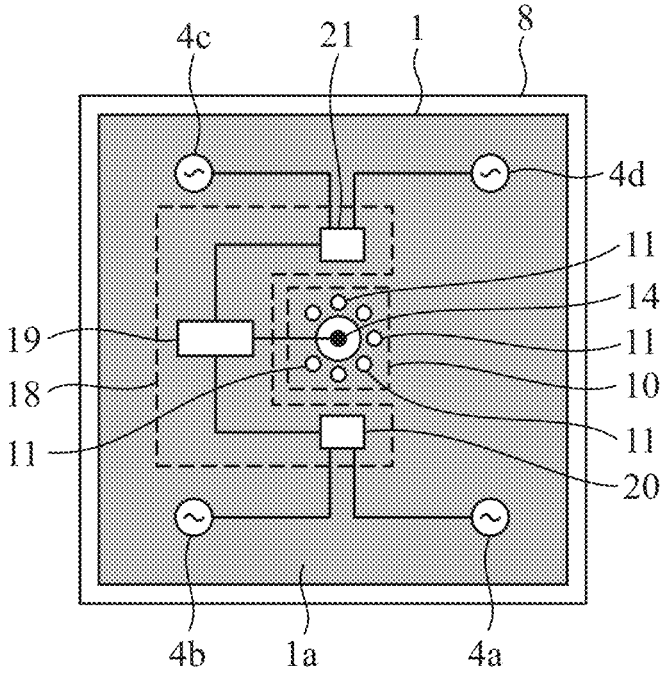
FIG. 3 is a plan view illustrating feeding points 4*a*, 4*b*, 4*c*, and 4*d* of element antennas 3*a*, 3*b*, 3*c*, and 3*d* in a first plane 1*a* of a first ground conductor 1, a coaxial line 10, and an interface circuit 18 on a first plane 1*a* of a first ground conductor 1.

FIG. 3 is a plan view illustrating feeding points 4*a*, 4*b*, 4*c*, and 4*d* of element antennas 3*a*, 3*b*, 3*c*, and 3*d*, a coaxial line 10, and an interface circuit 18 on a first plane 1*a* of a first ground conductor 1.

In FIGS. 1 to 3, the first ground conductor 1 has the first plane 1*a* and a second plane 1*b*.

The first ground conductor 1 is a flat plate having a square planar shape.

A circularly polarized wave transmitting/receiving unit 2 is arranged on the first plane 1*a* of the first ground conductor 1.

The circularly polarized wave transmitting/receiving unit 2 includes the element antennas 3*a*, 3*b*, 3*c*, and 3*d* that can transmit and receive circularly polarized waves.

In this first embodiment, an example will be explained in which the circularly polarized wave transmitting/receiving unit 2 has four element antennas 3*a*, 3*b*, 3*c*, and 3*d* as element antennas; however, the number of element antennas is only required to be plural, and is not limited to four.

The feeding points 4*a*, 4*b*, 4*c*, and 4*d* of the element antennas 3*a*, 3*b*, 3*c*, and 3*d* indicate, for example, positions where a signal output from the interface circuit 18 is input when a circularly polarized wave is transmitted. Although the feeding points 4*a*, 4*b*, 4*c*, and 4*d* are drawn in FIGS. 1 to 3; however, the feeding points 4*a*, 4*b*, 4*c*, and 4*d* are not formed as physical components of the antenna device.

The element antennas 3*a*, 3*b*, 3*c*, and 3*d* are inverted L antennas having bended points $3a_b$, $3b_b$, $3c_b$, and $3d_b$ between the feeding points 4*a*, 4*b*, 4*c*, and 4*d* and tips 5*a*, 5*b*, 5*c*, and 5*d*, respectively.

The total length of each of the element antennas 3*a*, 3*b*, 3*c*, and 3*d* is about a quarter wavelength at the resonance frequency.

In the element antennas 3*a*, 3*b*, 3*c*, and 3*d*, each of the tip portions extending from the bended points $3a_b$, $3b_b$, $3c_b$, and $3d_b$ to the tips 5*a*, 5*b*, 5*c*, and 5*d* is parallel to the first plane 1*a* of the first ground conductor 1.

Moreover, in the element antennas 3*a*, 3*b*, 3*c*, and 3*d*, directions from the bended points $3a_b$, $3b_b$, $3c_b$, and $3d_b$ to the tips 5*a*, 5*b*, 5*c*, and 5*d* are different from each other by 90 degrees, and are parallel to one of the sides of the first ground conductor 1.

In FIG. 1, the direction from the bended point $3a_b$ to the tip 5*a* is parallel to the lower side of the first ground conductor 1 on the paper, and the direction from the bended point $3b_b$ to the tip 5*b* is parallel to the left side of the first ground conductor 1 on the paper.

The direction from the bended point $3c_b$ to the tip 5*c* is parallel to the upper side of the first ground conductor 1 on the paper, and the direction from the bended point $3d_b$ to the tip 5*d* is parallel to the right side of the first ground conductor 1 on the paper.

A second ground conductor 6 is arranged in parallel with the first ground conductor 1 on a second plane 1*b* side of the first ground conductor 1.

The second ground conductor 6 is a flat plate having a square planar shape, and the length of each side of the second ground conductor 6 is half a wavelength at the resonance frequency of the element antennas 3*a*, 3*b*, 3*c*, and 3*d*.

Note that the length of each side of the second ground conductor 6 may be the length that completely matches the length of the half wavelength at the resonance frequency and may also be a length that substantially matches the length of the half wavelength at the resonance frequency.

A third ground conductor 7 is arranged in parallel with the second ground conductor 6 on the plane opposite to the plane on which the first ground conductor 1 is arranged out of the two planes of the second ground conductor 6.

The third ground conductor 7 is a flat plate having a square planar shape, and the length of each side of the third ground conductor 7 is longer than or equal to half a wavelength at the resonance frequency of the element antennas 3*a*, 3*b*, 3*c*, and 3*d*.

A first dielectric substrate 8 is arranged between the first ground conductor 1 and the second ground conductor 6.

A second dielectric substrate 9 is arranged between the second ground conductor 6 and the third ground conductor 7.

The length of each side of the second dielectric substrate 9 is longer than or equal to the length of each side of the third ground conductor 7 since the second ground conductor 6 and the third ground conductor 7 are copper foil patterns on the second dielectric substrate 9.

The coaxial line 10 includes an outer conductor 11 and an inner conductor 14. Although the coaxial line 10 is illustrated in FIGS. 2 and 3, the coaxial line 10 is not illustrated in FIG. 1 to simplify the drawing.

The outer conductor 11 is provided so as to pass through the second ground conductor 6, the first dielectric substrate 8, and the second dielectric substrate 9, and allows the first ground conductor 1, the second ground conductor 6, and the third ground conductor 7 to be conductive thereamong.

The outer conductor 11 includes a penetrating member 12 and a conductor 13, and one end thereof is connected to the second plane 1*b* of the first ground conductor 1 at a position surrounded by the feeding points 4*a*, 4*b*, 4*c*, and 4*d* of the element antennas 3*a*, 3*b*, 3*c*, and 3*d*.

In FIG. 3, an example is illustrated in which seven outer conductors 11 are arranged.

The penetrating member 12 is a through-hole member arranged at a position surrounded by the feeding points 4*a*, 4*b*, 4*c*, and 4*d* in the element antennas 3*a*, 3*b*, 3*c*, and 3*d* on the second plane 1*b* of the first ground conductor 1.

The conductor 13 is a metal member that is inserted in the penetrating member 12 to allow the first ground conductor 1, the second ground conductor 6, and the third ground conductor 7 to be conductive thereamong.

The inner conductor 14 is arranged at a position surrounded by the plurality of outer conductors 11, and one end 14*a* of the inner conductor 14 is connected to a 180-degree hybrid 19 of the interface circuit 18.

The other end 14*b* of the inner conductor 14 is connected to a circuit (not illustrated) for inputting and outputting signals.

A conductive member 15 includes a penetrating member 16 and a conductor 17, and one end thereof is connected to the second plane 1*b* of the first ground conductor 1 at a position surrounding the feeding points 4*a*, 4*b*, 4*c*, and 4*d* of the element antennas 3*a*, 3*b*, 3*c*, and 3*d*.

Although, in FIG. 2, an example is illustrated in which two conductive members 15 are arranged, tens or hundreds of conductive members 15 are often arranged in practice.

The conductive members 15 are provided so as to pass through the first dielectric substrate 8 and allow the first ground conductor 1 and the second ground conductor 6 to be conductive therebetween.

The penetrating members 16 are through-hole members arranged at positions surrounding the feeding points 4*a*, 4*b*, 4*c*, and 4*d* in the element antennas 3*a*, 3*b*, 3*c*, and 3*d* on the second plane 1*b* of the first ground conductor 1.

The conductor 17 is a metal member that is inserted in a penetrating member 16 to allow the first ground conductor 1 and the second ground conductor 6 to be conductive therebetween.

The interface circuit 18 includes the 180-degree hybrid 19 and 90-degree hybrids 20 and 21, and is patterned on the first plane 1*a* of the first ground conductor 1 by etching.

The interface circuit 18 combines four signals having mutually different phases output from each of the feeding points 4*a*, 4*b*, 4*c*, and 4*d* of the element antennas 3*a*, 3*b*, 3*c*, and 3*d* and outputs the combined signal to the coaxial line 10 when the element antennas 3*a*, 3*b*, 3*c*, and 3*d* are used as reception antennas.

The interface circuit 18 divides a signal transmitted by the coaxial line 10 into four signals having mutually different phases and outputs each of the divided four signals to one of the feeding points 4*a*, 4*b*, 4*c*, and 4*d* of the element antennas 3*a*, 3*b*, 3*c*, and 3*d* when the element antennas 3*a*, 3*b*, 3*c*, and 3*d* are used as transmission antennas.

Although the interface circuit 18 is illustrated in FIG. 3, the interface circuit 18 is not illustrated in FIG. 1 nor 2 to simplify the drawings.

The 180-degree hybrid 19 combines, for example, a signal having a phase of 0 degrees output from the 90-degree hybrid 20 and, for example, a signal having a phase of 180 degrees output from the 90-degree hybrid 21 and outputs the combined signal to the coaxial line 10 when the element antennas 3*a*, 3*b*, 3*c*, and 3*d* are used as reception antennas.

The 180-degree hybrid 19 divides a signal transmitted by the coaxial line 10 into two signals having phases that are 180 degrees different from each other, and outputs one of the divided signals to the 90-degree hybrid 20 and the other divided signal to the 90-degree hybrid 21 when the element antennas 3*a*, 3*b*, 3*c*, and 3*d* are used as transmission antennas.

For example, in a case where the phase of one of the divided signals is 0 degrees, the phase of the signal output from the 180-degree hybrid 19 to the 90-degree hybrid 20 is 0 degrees, and the phase of the signal output from the 180-degree hybrid 19 to the 90-degree hybrid 21 is 180 degrees.

The 90-degree hybrid 20 combines, for example, a signal having a phase of 0 degrees output from the feeding point 4*a* of the element antenna 3*a* and, for example, a signal having a phase of 90 degrees output from the feeding point 4*b* of the element antenna 3*b* and outputs a synthesized signal having a phase of 0 degrees to the 180-degree hybrid 19 when the element antennas 3*a*, 3*b*, 3*c*, and 3*d* are used as reception antennas.

The 90-degree hybrid 20 divides, for example, a signal having a phase of 0 degrees output from the 180-degree hybrid 19 into a signal having a phase of 0 degrees and a signal having a phase of 90 degrees, and outputs the divided signal having the phase of 0 degrees to the feeding point 4*a* of the element antenna 3*a* and the divided signal having the phase of 90 degrees to the feeding point 4*b* of the element antenna 3*b* when the element antennas 3*a*, 3*b*, 3*c*, and 3*d* are used as transmission antennas.

The 90-degree hybrid 21 combines a signal having, for example, a phase of 180 degrees output from the feeding point 4*c* of the element antenna 3*c* and a signal having, for example, a phase of 270 degrees output from the feeding point 4*d* of the element antenna 3*d* and outputs a synthesized signal having a phase of 180 degrees to the 180-degree hybrid 19 when the element antennas 3*a*, 3*b*, 3*c*, and 3*d* are used as reception antennas.

The 90-degree hybrid 21 divides, for example, a signal having a phase of 180 degrees output from the 180-degree hybrid 19 into a signal having a phase of 180 degrees and a signal having a phase of 270 degrees, and outputs the divided signal having the phase of 180 degrees to the feeding point 4*c* of the element antenna 3*c* and the divided signal having the phase of 270 degrees to the feeding point 4*d* of the element antenna 3*d* when the element antennas 3*a*, 3*b*, 3*c*, and 3*d* are used as transmission antennas.

In the first embodiment, the portion sandwiched between the second ground conductor 6 and the third ground conductor 7 operates as a microstrip resonator 22.

Next, the operation will be described.

Since the operation when the element antennas 3*a*, 3*b*, 3*c*, and 3*d* are used as transmission antennas and the operation when the element antennas 3*a*, 3*b*, 3*c*, and 3*d* are used as reception antennas are reversible, here, the operation when the element antennas 3*a*, 3*b*, 3*c*, and 3*d* are used as transmission antennas will be described representatively.

When a signal is given from the circuit not illustrated to the other end 14*b* of the inner conductor 14 in the coaxial line 10, the signal given from the circuit not illustrated is transmitted to the one end 14*a* of the coaxial line 10 and then is transmitted to the interface circuit 18.

Here, for convenience of explanation, it is assumed that the phase of the signal output from the one end 14*a* of the coaxial line 10 to the interface circuit 18 is 0 degrees.

The 180-degree hybrid 19 of the interface circuit 18 divides the signal having the phase of 0 degrees output from the one end 14*a* of the coaxial line 10 into two signals having phases that are 180 degrees different from each other, and outputs a signal having a phase of 0 degrees to the 90-degree hybrid 20 and a signal having a phase of 180 degrees to the 90-degree hybrid 21.

The 90-degree hybrid 20 divides the signal having the phase of 0 degrees output from the 180-degree hybrid 19 into two signals having phases that are 90 degrees different from each other, and outputs a signal having a phase of 0 degrees to the feeding point 4*a* of the element antenna 3*a* and a signal having a phase of 90 degrees to the feeding point 4*b* of the element antenna 3*b*.

The 90-degree hybrid 21 divides the signal having the phase of 180 degrees output from the 180-degree hybrid 19 into two signals having phases that are 90 degrees different from each other, and outputs a signal having a phase of 180 degrees to the feeding point 4*c* of the element antenna 3*c* and a signal having a phase of 270 degrees to the feeding point 4*d* of the element antenna 3*d*.

As a result, the element antennas 3*a*, 3*b*, 3*c*, and 3*d* of the circularly polarized wave transmitting/receiving unit 2 are provided with signals whose phases are different from each other by 90 degrees, and an electromagnetic wave corresponding to the signals is radiated into a space as a result of the resonance phenomenon generated when the signals are transmitted through the element antennas 3*a*, 3*b*, 3*c*, and 3*d*.

Since the phases of the signals transmitted through the element antennas 3*a*, 3*b*, 3*c*, and 3*d* are different from each other by 90 degrees, RHCP which is a desired electromagnetic wave is radiated in the zenith direction (0 deg) illustrated in FIG. 2 and LHCP which is an unwanted electromagnetic wave is radiated in the ground direction (±90 deg).

Figure 4:
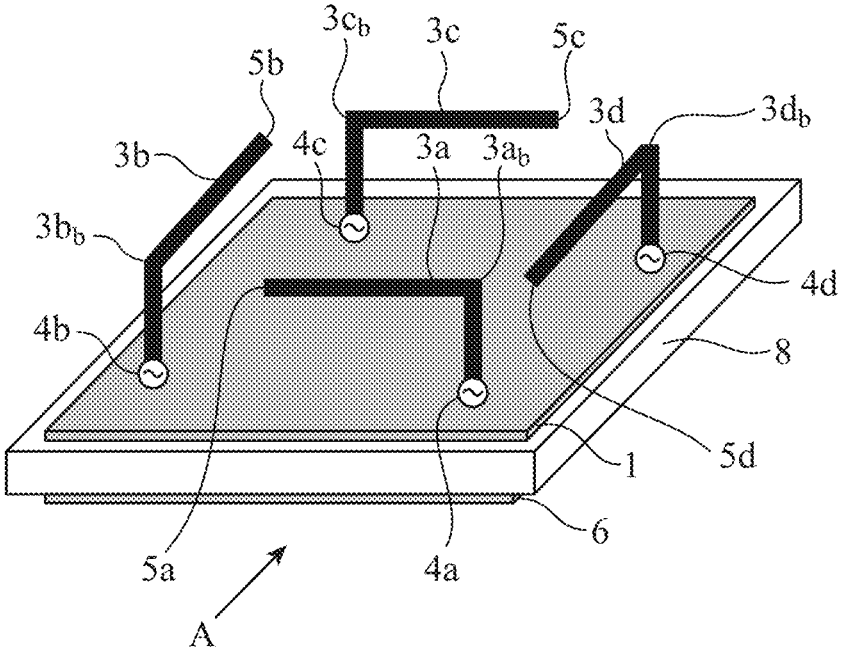
FIG. 4 is a perspective view illustrating an antenna device not including a third ground conductor 7 nor a second dielectric substrate 9.
Figure 5:
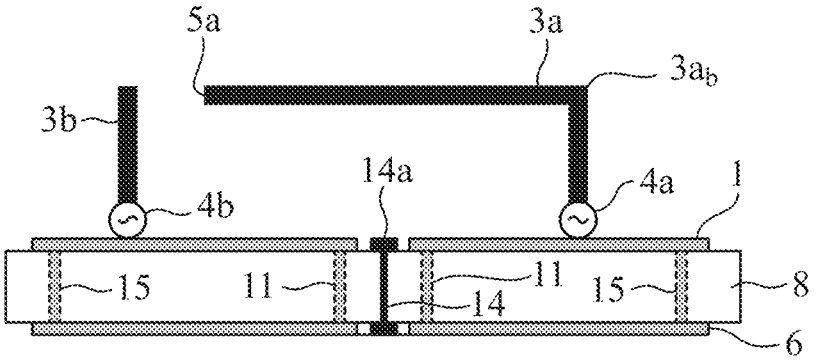
FIG. 5 is a cross-sectional side view of the antenna device of FIG. 4 as viewed from direction A.

The antenna device includes the third ground conductor 7 and the second dielectric substrate 9 in the first embodiment; however, a case is assumed as illustrated in FIGS. 4 and 5 in which the antenna device does not include the third ground conductor 7 nor the second dielectric substrate 9.

FIG. 4 is a perspective view illustrating an antenna device not including the third ground conductor 7 nor the second dielectric substrate 9.

FIG. 5 is a cross-sectional side view of the antenna device of FIG. 4 as viewed from direction A.

Figure 6:
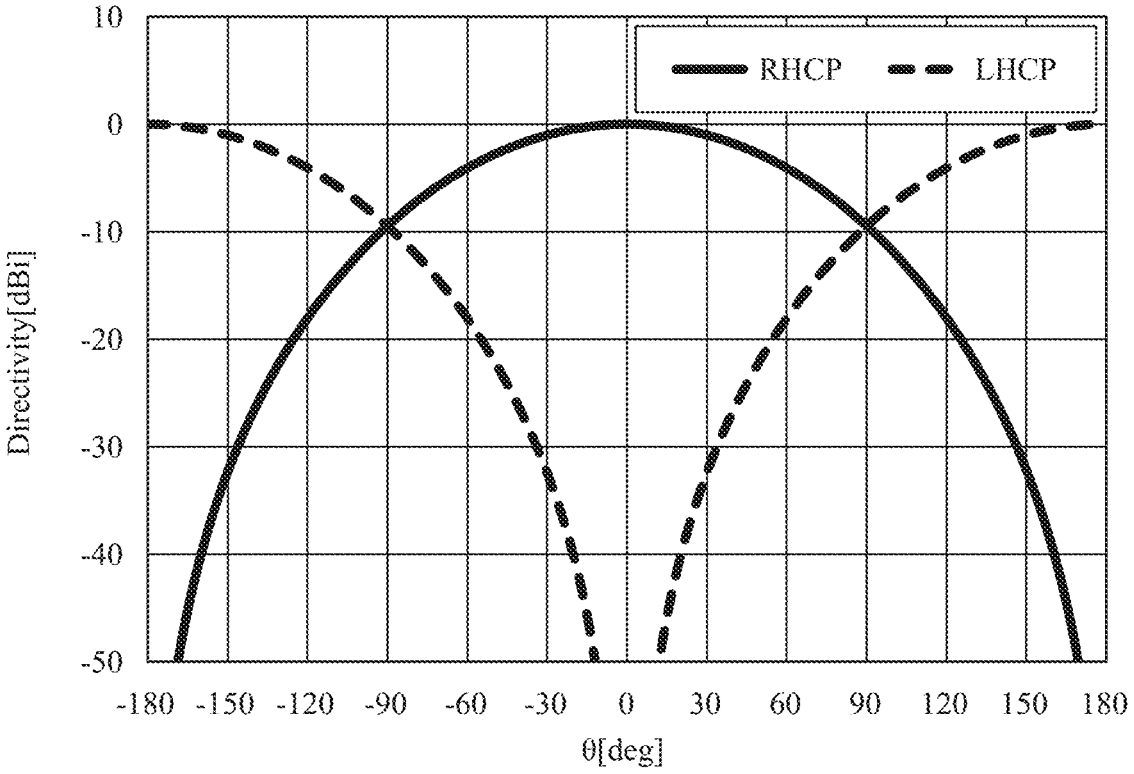
FIG. 6 is an explanatory graph illustrating the RHCP gain and the LHCP gain in an antenna device in which a first dielectric substrate 8, a first ground conductor 1, and a second ground conductor 6 each have a short side.

In a case of an antenna device in which the length of each side of the first dielectric substrate 8, the first ground conductor 1, and the second ground conductor 6 is short, the values of the RHCP gain and the LHCP gain are substantially the same as illustrated in FIG. 6. As an example in which the length of each side of the second ground conductor 6 is short, the length of half a wavelength at the resonance frequency of the element antennas 3*a*, 3*b*, 3*c*, and 3*d* is conceivable.

FIG. 6 is an explanatory graph illustrating the RHCP gain and the LHCP gain in an antenna device in which each side of the first dielectric substrate 8, the first ground conductor 1, and the second ground conductor 6 is short.

The horizontal axis in FIG. 6 represents the zenith angles of RHCP and LHCP, and the vertical axis in FIG. 6 represents the gains of the RHCP and the LHCP.

For example, when an RHCP signal is transmitted to the ground from a GPS satellite or a quasi-zenith satellite, the RHCP signal is reflected by the ground, a building, etc., and the RHCP signal is inverted to generate LHCP.

Since the antenna device, in which each side of the first dielectric substrate 8, the first ground conductor 1, and the second ground conductor 6 is short, has substantially the same value for the RHCP gain and the LHCP gain, there is a high possibility that an LHCP signal, which is an unwanted wave, is received erroneously when the antenna device is used for receiving an RHCP signal transmitted from the GPS satellite or the quasi-zenith satellite to the ground. Therefore, the possibility of incurring degradation of the positioning performance based on the RHCP increases.

In the first embodiment, the antenna device includes the third ground conductor 7 and the second dielectric substrate 9 in order to reduce the possibility of erroneously receiving an LHCP signal that is an unwanted wave even in the case where the length of each side of the first dielectric substrate 8, the first ground conductor 1, and the second ground conductor 6 is small.

In the first embodiment, the length of each side of the second ground conductor 6 equals the length of half a wavelength at the resonance frequency of the element antennas 3*a*, 3*b*, 3*c*, and 3*d*.

The length of each side of the third ground conductor 7 is longer than or equal to the length of the half wavelength at the resonance frequency of the element antennas 3*a*, 3*b*, 3*c*, and 3*d*.

Moreover, the length of each side of the second dielectric substrate 9 is longer than or equal to the length of each side of the third ground conductor 7.

Therefore, a resonance phenomenon occurs in the microstrip resonator 22 due to electromagnetic waves transmitted and received by the element antennas 3*a*, 3*b*, 3*c*, and 3*d*.

Therefore, by adjusting the resonance frequency of the element antennas 3*a*, 3*b*, 3*c*, and 3*d* and the resonance frequency of the microstrip resonator 22, a broadband impedance characteristic can be obtained. Moreover, not only that a broadband impedance characteristic can be obtained, but also the broadband impedance characteristic can be maintained even when the antenna device is installed on a large ground plate.

That is, although the resonance frequency of the microstrip resonator 22 slightly changes being affected by the fringing effect when the antenna device is installed on a large ground plate, but there is no significant difference from the case where the antenna device is not installed on a large ground plate. Therefore, even when the antenna device is installed on a large ground plate, a broadband impedance characteristic can be maintained.

Note that the wider the gap between the second ground conductor 6 and the third ground conductor 7 is, the wider the band of the microstrip resonator 22 becomes, and thus a broadband impedance characteristic can be obtained.

Furthermore, when the resonance frequency of the element antennas 3*a*, 3*b*, 3*c*, and 3*d* and the resonance frequency of the microstrip resonator 22 are adjusted to the same level, the radiation pattern of the antenna device is obtained by superimposing the radiation pattern of the circularly polarized wave transmitting/receiving unit 2 as a current source and the radiation pattern of the microstrip resonator 22 as a magnetic current source.

Figure 7:
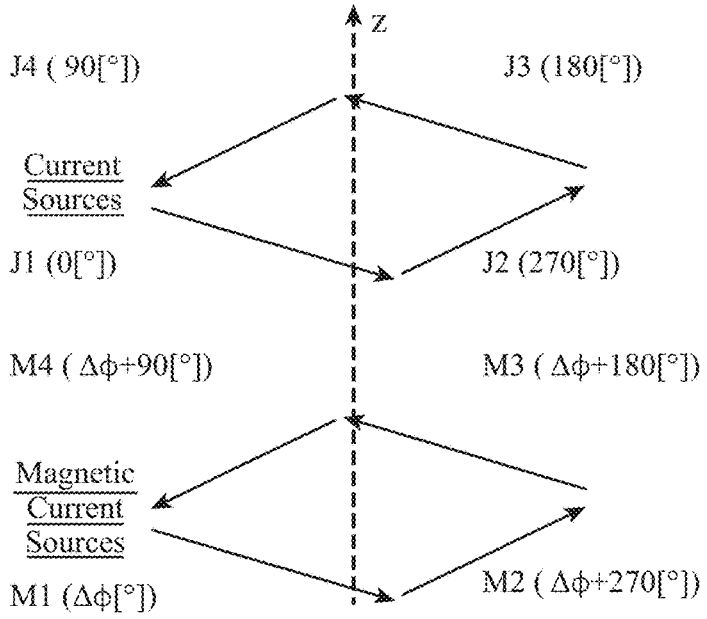
FIG. 7 is an explanatory diagram illustrating a simple model including current sources (J1 to J4) and magnetic current sources (M1 to M4).

As illustrated in FIG. 7, the radiation pattern obtained by the antenna device can be expressed by a simple model including current sources (J1 to J4) and magnetic current sources (M1 to M4).

FIG. 7 is an explanatory diagram illustrating a simple model including the current sources (J1 to J4) and the magnetic current sources (M1 to M4).

In this example, the phase differences between the current sources (J1 to J4) are 90 degrees each and the phase differences between the magnetic current sources (M1 to M4) are 90 degrees each so that RHCP is radiated in the zenith direction.

It is also assumed that the amplitudes of the current sources (J1 to J4) and the amplitudes of the magnetic current sources (M1 to M4) are all equal and that a phase difference between a current source (Jn: n=1, 2, 3, 4) and a magnetic current source (Mn: n=1, 2, 3, 4) is $\Delta\varphi$.

Although the positions of the current sources and the magnetic current sources appear to be different in FIG. 7, they are assumed to be in the same position.

By performing electromagnetic field analysis on the basis of the relationship illustrated in FIG. 7, the relationship between the phase difference $\Delta\varphi$ between a current source (Jn) and a magnetic current source (Mn) and the peak value of the radiation pattern is simulated.

Figure 8:
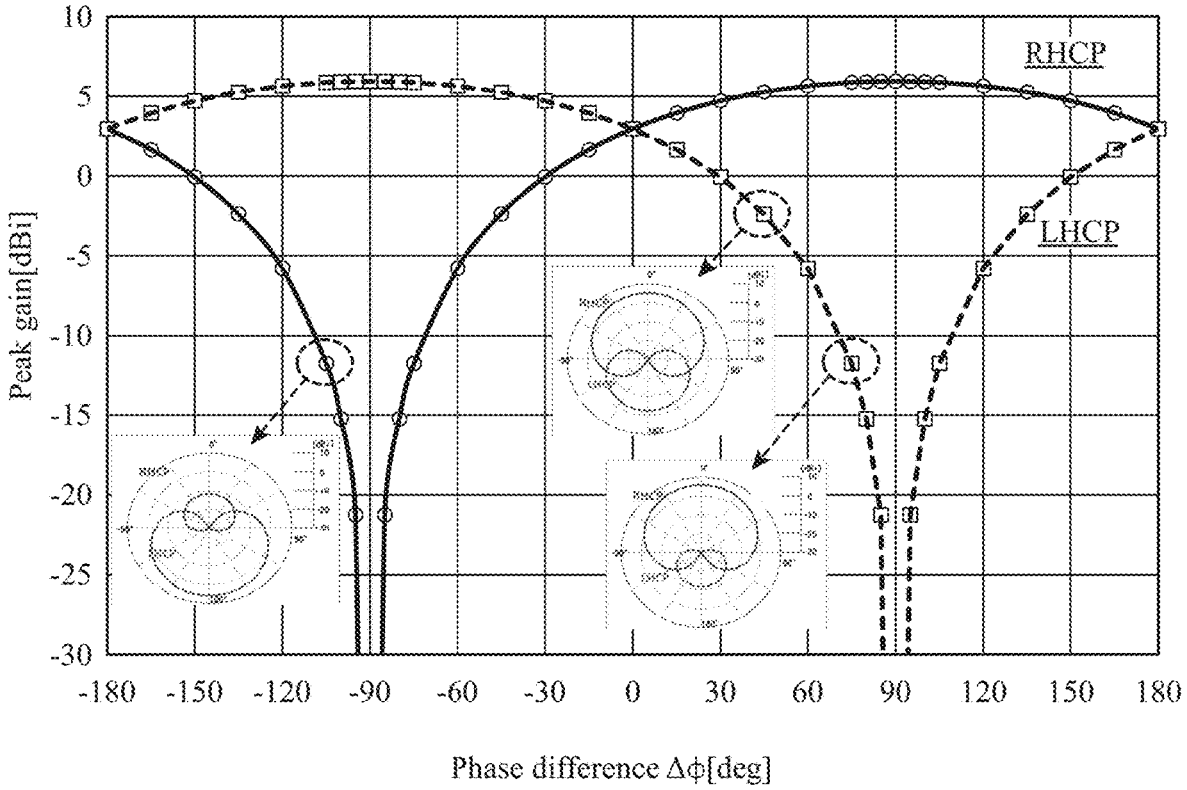
FIG. 8 is an explanatory graph illustrating a simulation result of a correspondence relationship between the phase difference $\Delta\varphi$ and peak values of radiation patterns.

FIG. 8 is an explanatory graph illustrating a simulation result of the correspondence relationship between the phase difference $\Delta\varphi$ and the peak values of the radiation patterns.

The horizontal axis in FIG. 8 represents the phase difference $\Delta\varphi$ between the current source (Jn) and the magnetic current source (Mn), and the vertical axis in FIG. 8 represents the peak value of the radiation patterns.

FIG. 8 indicates that LHCP can be suppressed when the phase difference $\Delta\varphi$ is positive and the phase of the magnetic current source (Mn) is delayed from the phase of the current source (Jn). When $\Delta\varphi$=90 degrees, LHCP is most suppressed.

The relationship between the phase difference $\Delta\varphi$ and the peak values of the radiation patterns is dependent on the physical positions of the element antennas 3*a*, 3*b*, 3*c*, and 3*d* but also contributes to the phase centers of the element antennas 3*a*, 3*b*, 3*c*, and 3*d*. Therefore, it becomes possible to adjust the suppression amount of LHCP by adopting inverted L antennas as the element antennas 3*a*, 3*b*, 3*c*, and 3*d* to allow the phase centers of the element antennas 3*a*, 3*b*, 3*c*, and 3*d* to move in the vertical direction that is the zenith direction (0 deg).

Specifically, the suppression amount of LHCP can be adjusted by changing the shapes of the element antennas 3*a*, 3*b*, 3*c*, and 3*d*. As a result, as illustrated in FIG. 9, a radiation pattern having a high gain and a low cross-polarization (LHCP) can be obtained.

Figure 9:
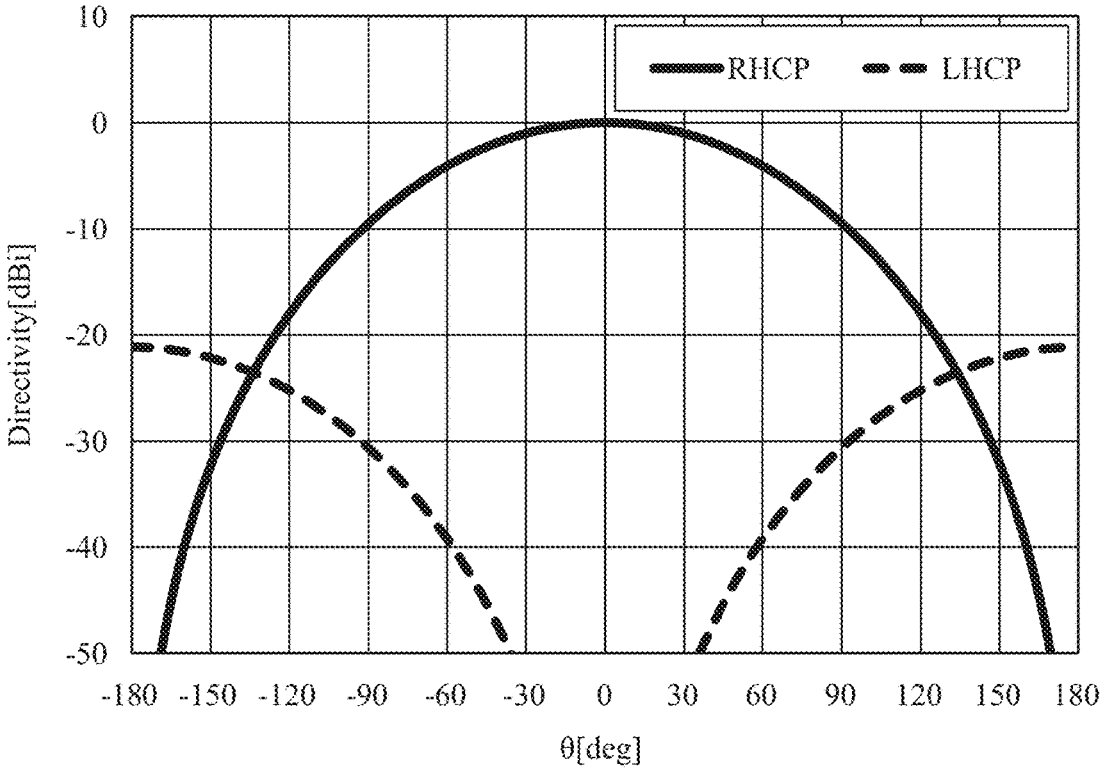
FIG. 9 is an explanatory diagram illustrating the RHCP gain and the LHCP gain in an antenna device.

FIG. 9 is an explanatory diagram illustrating the RHCP gain and the LHCP gain in the antenna device.

The horizontal axis in FIG. 9 represents the zenith angle of RHCP and LHCP, and the vertical axis in FIG. 9 represents the RHCP and LHCP gains.

In FIG. 9, the phase difference $\Delta\varphi$ is adjusted to 90 degrees, and the LHCP is most suppressed at a phase of 0 degrees.

As is apparent from the above, according to the first embodiment, included are: the coaxial line 10 provided so as to pass through the second ground conductor 6 and the first and second dielectric substrates 8 and 9, the coaxial line 10 including the outer conductor 11 allowing the first ground conductor 1, the second ground conductor 6, and the third ground conductor 7 to be conductive thereamong; and the conductive member 15 provided so as to pass through the first dielectric substrate 8, the conductive member 15 allowing the first ground conductor 1 and the second ground conductor 6 to be conductive therebetween, and the interface circuit 18 combines a plurality of signals having mutually different phases output from each of the plurality of element antennas 3*a*, 3*b*, 3*c*, and 3*d* and outputs the combined signal to the coaxial line 10. This allows the resonance frequency to be adjusted to suppress reception of unnecessary back lobes without mounting a complex choke structure.

Although the example in which the element antennas 3*a*, 3*b*, 3*c*, and 3*d* are inverted L antennas is described in the first embodiment, the antennas are only required to have element shapes having directivity in the zenith direction, and the element antennas 3*a*, 3*b*, 3*c*, and 3*d* are not limited to inverted L antennas.

Figure 10A:
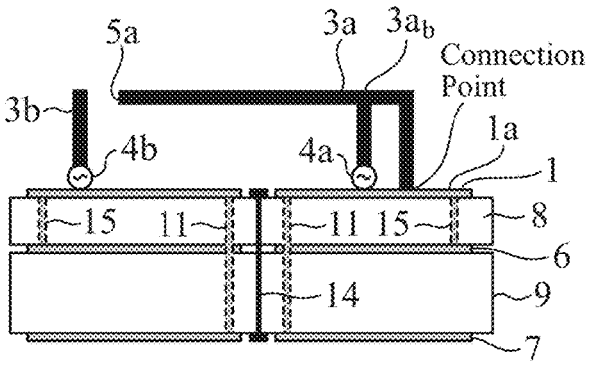
FIG. 10A is an explanatory diagram illustrating an example in which element antennas are inverted F antennas.
Figure 10B:
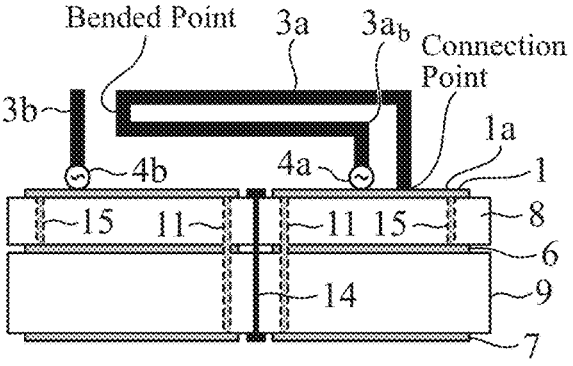
FIG. 10B is an explanatory diagram illustrating an example in which element antennas are folded monopole antennas.

For example, the element antennas 3*a*, 3*b*, 3*c*, and 3*d* may be inverted antennas as illustrated in FIG. 10A, or may be folded monopole antennas as illustrated in FIG. 10B.

FIG. 10A is an explanatory diagram illustrating an example in which the element antennas are inverted F antennas, and FIG. 10B is an explanatory diagram illustrating an example in which the element antennas are folded monopole antennas.

Like the inverted L antennas, the inverted antennas have feeding points 4*a*, 4*b*, 4*c*, and 4*d*, and also have connection points with the first plane 1*a* of the first ground conductor 1.

In the case where the element antennas 3*a*, 3*b*, 3*c*, and 3*d* are inverted antennas, the lengths from the feeding points 4*a*, 4*b*, 4*c*, and 4*d* to the tips 5*a*, 5*b*, 5*c*, and 5*d* are about a quarter wavelength at the resonance frequency.

In the inverted antennas, each of the tip portions extending from bended points $3a_b$, $3b_b$, $3c_b$, and $3d_b$ to tips 5*a*, 5*b*, 5*c*, and 5*d* is parallel to the first plane 1*a* of the first ground conductor 1.

Moreover, in the inverted F typo antennas, directions from the bended points $3a_b$, $3b_b$, $3c_b$, and $3d_b$ to the tips 5*a*, 5*b*, 5*c*, and 5*d* are different from each other by 90 degrees, and are parallel to one of the sides of the first ground conductor 1.

Like the inverted L antennas, the folded monopole antennas have feeding points 4*a*, 4*b*, 4*c*, and 4*d*, and also have connection points with the first plane 1*a* of the first ground conductor 1.

In the case where the element antennas 3*a*, 3*b*, 3*c*, and 3*d* are folded monopole antennas, the lengths from the feeding points 4*a*, 4*b*, 4*c*, and 4*d* to the connection points are about half a wavelength at the resonance frequency.

In the folded monopole antennas, each of the portions extending from bended points $3a_b$, $3b_b$, $3c_b$, and $3d_b$ to folded points is parallel to the first plane 1*a* of the first ground conductor 1.

Moreover, in the folded monopole antennas, directions from the bended points $3a_b$, $3b_b$, $3c_b$, and $3d_b$ to the folded points are different from each other by 90 degrees, and are parallel to any one of the sides of the first ground conductor 1.

Furthermore, since the element antennas 3*a*, 3*b*, 3*c*, and 3*d* are only required to be element-type antennas having directivity in the zenith direction, antennas such as loop antennas, helical antennas or meander antennas may be used.

In the first embodiment, the antenna device having four feeding points is illustrated; however, for example, an antenna device having two feeding points or one feeding point may be used.

In the first embodiment, the example in which the circularly polarized wave transmitting/receiving unit 2 includes the element antennas 3*a*, 3*b*, 3*c*, and 3*d* is illustrated; however, a passive element 30 corresponding to each of the element antennas 3*a*, 3*b*, 3*c*, and 3*d* may be included as illustrated in FIG. 11.

Figure 11A:
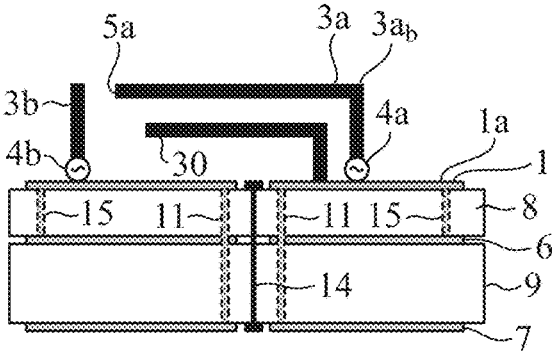
FIG. 11A is an explanatory diagram illustrating an example in which element antennas that are inverted L antennas and a passive element 30 are included.
Figure 11B:
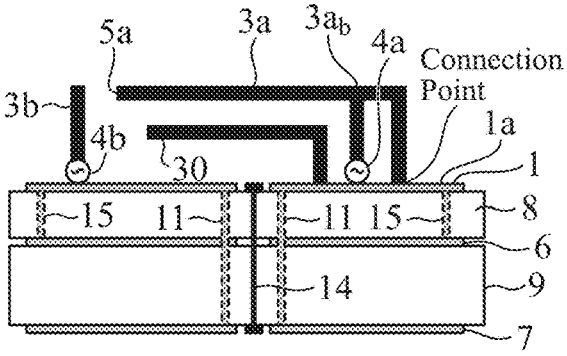
FIG. 11B is an explanatory diagram illustrating an example in which element antennas that are inverted F antennas and a passive element 30 are included.
Figure 11C:
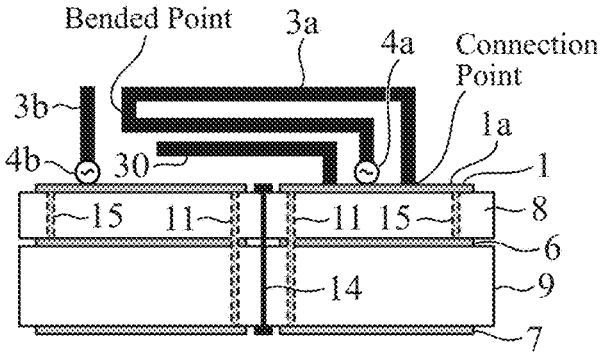
FIG. 11C is an explanatory diagram illustrating an example in which element antennas that are folded monopole antennas and a passive element 30 are included.

FIG. 11A is an explanatory diagram illustrating an example in which element antennas that are inverted L antennas and passive elements 30 are included, FIG. 11B is an explanatory diagram illustrating an example in which element antennas that are inverted F antennas and passive elements 30 are included, and FIG. 11C is an explanatory diagram illustrating an example in which element antennas that are folded monopole antennas and passive elements 30 are included.

With the circularly polarized wave transmitting/receiving unit 2 including the passive elements 30 in addition to the element antennas 3*a*, 3*b*, 3*c*, and 3*d*, the antenna device functions as a multiband antenna that resonates in a plurality of bands.

In the case of the multiband antenna using the passive elements 30, it is possible to adjust the coupling amount of the element antennas 3*a*, 3*b*, 3*c*, and 3*d*. For this reason, for example, it is possible to suppress unwanted waves of long term evolution (LTE) of the 1.5 GHz band that is between multiple frequencies used in the quasi-zenith satellites.

In the case of using the passive elements 30, there is an advantage that the cost can be reduced as compared with a case where a high-performance filter is used to suppress unwanted waves of the LTE.

Although the example is illustrated in the first embodiment in which a signal is given from the other end 14*b* of the inner conductor 14 in the coaxial line 10 when the element antennas 3*a*, 3*b*, 3*c*, and 3*d* are used as transmission antennas, a signal may be given from a side surface of the first ground conductor 1, for example.

In FIG. 2, the side surface of the first ground conductor 1 may be, for example, on the left side or the right side, on the paper, of the first ground conductor 1.

In the case where a signal is given from the side surface of the first ground conductor 1, the coaxial line 10 penetrating through the substrates becomes unnecessary. However, this results in asymmetry in the structure, thus deteriorating the axial ratio, and thus it is desirable that a signal is given from the other end 14*b* of the inner conductor 14 in the coaxial line 10.

In the first embodiment, the example is illustrated in which the interface circuit 18 is patterned on the first plane 1*a* of the first ground conductor 1 by etching.

However, this is merely an example. For example, the interface circuit 18 may be formed using a chip component or the like.

In the first embodiment, the example is illustrated in which the coaxial line 10 capable of signal transmission is formed with the plurality of outer conductors 11 arranged at positions surrounding the inner conductor 14.

In this case, although it is desirable that the intervals between the multiple outer conductors 11 be dense, if the intervals are too narrow, a line drawn from the inner conductor 14 in the coaxial line 10 to the interface circuit 18 cannot be formed.

For this reason, the plurality of outer conductors 11 is arranged in a C shape in the first embodiment as illustrated in FIG. 3. Specifically, an interval between two outer conductors 11 is widened only at a position where a line is drawn from the inner conductor 14 in the coaxial line 10 to the interface circuit 18 as compared to other positions.

Although the example is illustrated in the first embodiment in which the planar shapes of the first ground conductor 1, the second ground conductor 6, the third ground conductor 7, the first dielectric substrate 8, and the second dielectric substrate 9 is a square, the present embodiment is not limited to the example of square planar shapes. For example, as illustrated in FIG. 12, the planar shapes of the first ground conductor 1, the second ground conductor 6, the third ground conductor 7, the first dielectric substrate 8, and the second dielectric substrate 9 may be circular.

Figure 12:
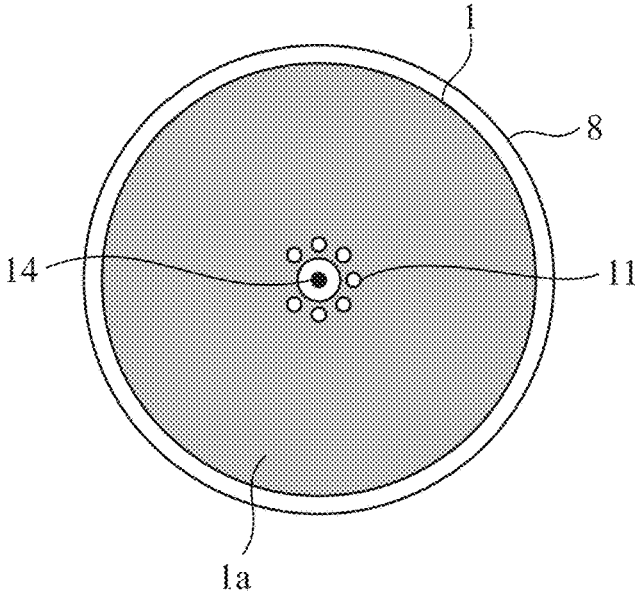
FIG. 12 is a plan view illustrating a first ground conductor 1 and a first dielectric substrate 8 having circular planar shapes.

FIG. 12 is a plan view illustrating a first ground conductor 1 and a first dielectric substrate 8 having circular planar shapes.

In FIG. 12, for simplification of the drawing, feeding points 4*a*, 4*b*, 4*c*, and 4*d* of element antennas 3*a*, 3*b*, 3*c*, and 3*d* and an interface circuit 18 are not illustrated.

Figure 13:
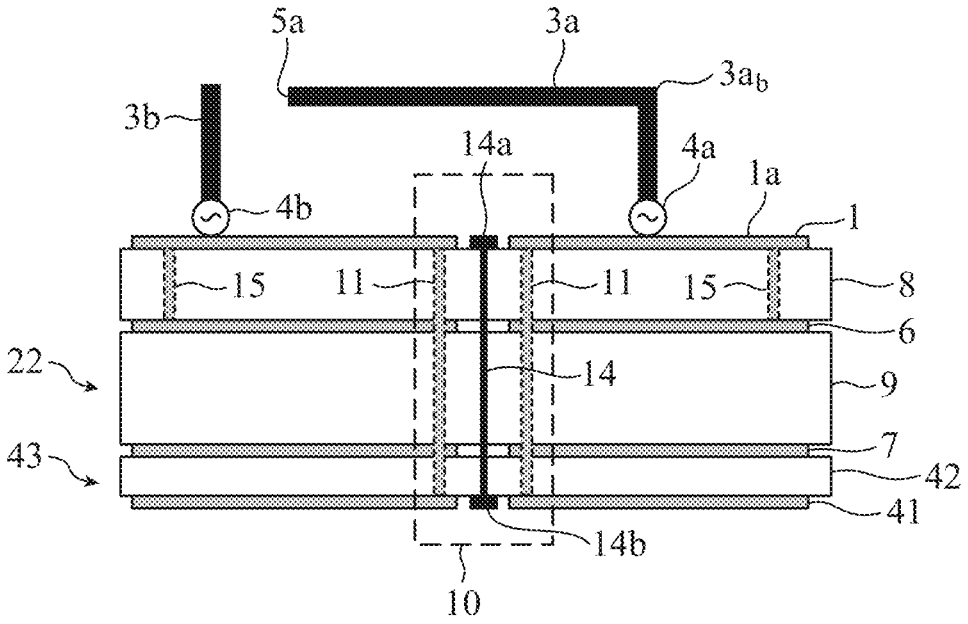
FIG. 13 is a cross-sectional side view illustrating another antenna device according to the first embodiment of the invention.

The example is illustrated in the first embodiment in which the first ground conductor 1, the second ground conductor 6, the third ground conductor 7, the first dielectric substrate 8, and the second dielectric substrate 9 are multilayered; however, a fourth ground conductor 41 and a third dielectric substrate 42 may be multilayered as illustrated in FIG. 13.

FIG. 13 is a cross-sectional side view illustrating another antenna device according to the first embodiment of the invention.

In FIG. 13, the fourth ground conductor 41 is arranged in parallel with the third ground conductor 7 on, of the two planes of the third ground conductor 7, a plane opposite to the plane on which the second ground conductor 6 is arranged.

The third dielectric substrate 42 is arranged between the third ground conductor 7 and the fourth ground conductor 41.

In the antenna device illustrated in FIG. 13, the portion sandwiched between the second ground conductor 6 and the third ground conductor 7 operates as the microstrip resonator 22, and in addition to this, the portion sandwiched by the third ground conductor 7 and the fourth ground conductor 41 operates as a microstrip resonator 43.

Therefore, by adding the fourth ground conductor 41 having sides the length of which is about half a wavelength at a desired frequency, a radiation pattern characteristic having a low cross-polarization can be obtained in multiple frequency bands.

Second Embodiment

In the first embodiment, the example in which the planar shape of the second ground conductor 6 is a square is illustrated.

Figure 14:
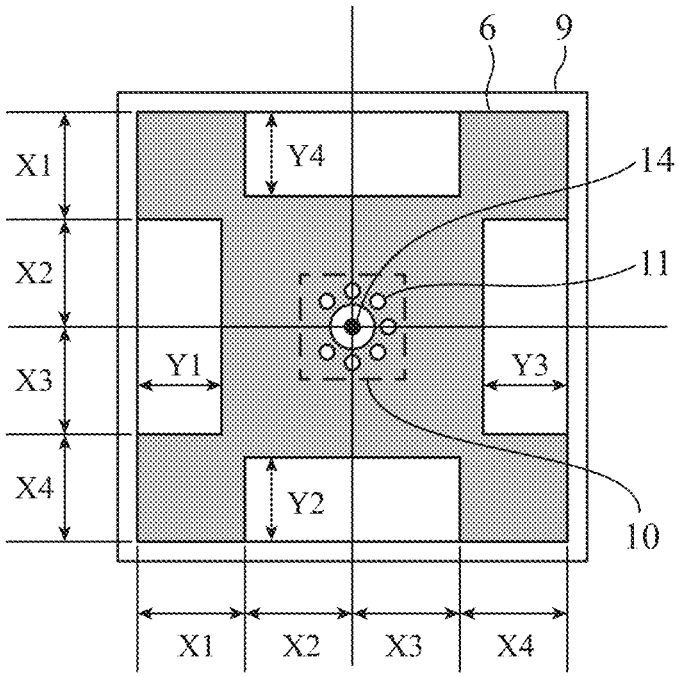
FIG. 14 is a plan view illustrating a planar shape of a second ground conductor 6 in the antenna device according to a second embodiment of the present invention.

In a second embodiment, an example in which notches are formed in each of the four sides of a second ground conductor 6 as illustrated in FIG. 14 will be described.

FIG. 14 is a plan view illustrating the planar shape of the second ground conductor 6 in the antenna device according to the second embodiment of the present invention. In FIG. 14, the same symbol as that in FIGS. 1 to 3 represents the same or a corresponding part.

In the example of FIG. 14, a coaxial line 10 is arranged at the center of the second ground conductor 6.

Symbols X1, X2, X3, and X4 represent the dimensions of the respective sides of the second ground conductor 6, and X1=X2=X3=X4 holds.

Symbols Y1, Y2, Y3, and Y4 indicate the notch size of the sides of the second ground conductor 6.

Where Y1<X1, Y2<X4, Y3<X4, Y4<X1, and Y1=Y2=Y3=Y4 hold.

The second ground conductor 6 having a square planar shape is notched with the same notch size at the center of each of the four sides.

Specifically, in FIG. 14, the dimensions of the notches of the upper side on the paper (hereinafter referred to as the upper side), the lower side on the paper (hereinafter referred to as the lower side), the left side on the paper (hereinafter referred to as the left side), and the right side on the paper (hereinafter referred to as the right side), of the second ground conductor 6, are all X2+X3.

Furthermore, the notch sizes on the upper side, the lower side, the left side, and the right side of the second ground conductor 6 are all Y (=Y1=Y2=Y3=Y4).

Therefore, even with the notches, the planar shape of the second ground conductor 6 maintains symmetry, and thus the axial ratio characteristic can be maintained.

Since the path of a signal flowing through the second ground conductor 6 becomes longer when a notch is formed in each of the four sides of the second ground conductor 6, the operation frequency of the microstrip resonator 22 shifts to the lower frequency side.

The resonance frequency can be adjusted by adjusting the notch size Y on the upper side, the lower side, the left side, and the right side of the second ground conductor 6. Therefore, the phase relationship can be adjusted not only by the arrangement and the shapes of the element antennas 3*a*, 3*b*, 3*c*, and 3*d* but also by modifying the shape of the second ground conductor 6 by the notches when the phase relationship between the circularly polarized wave transmitting/receiving unit 2 that is a current source and the microstrip resonator 22 that is a magnetic current source is adjusted.

In the second embodiment, the example in which Y1=Y2=Y3=Y4 holds for the notch sizes is illustrated in order to maintain the axial ratio characteristic and to prevent cross polarized waves from increasing.

In a case where there is no particular problem even if some cross polarized waves increase due to asymmetry, the notch sizes may be, for example, Y1≠Y2≠Y3≠Y4. Moreover, (X2+X3)≠(X1+X4) may be satisfied.

Although the example is illustrated in the second embodiment in which each of the four sides of the second ground conductor 6 is notched; however, each of the four sides of the third ground conductor 7 may be notched.

Third Embodiment

In the first embodiment, the example is illustrated in which the element antennas 3*a*, 3*b*, 3*c*, and 3*d* are arranged on the first plane 1*a* of the first ground conductor 1.

In a third embodiment, an example will be described in which third dielectric substrates 51 arranged on a first plane 1*a* of a first ground conductor 1 are further included, and element antennas 3*a*, 3*b*, 3*c*, and 3*d* are formed in the third dielectric substrates 51.

Figure 15:
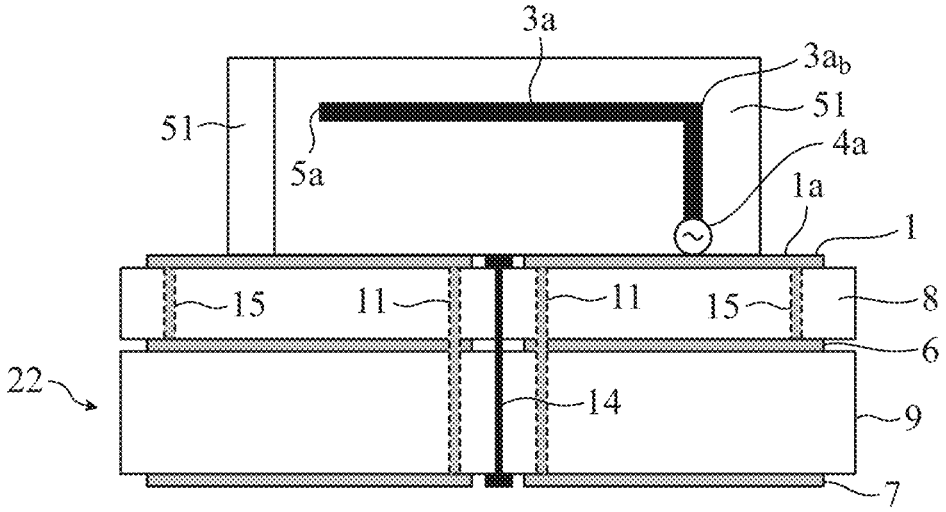
FIG. 15 is a cross-sectional side view illustrating an antenna device according to a third embodiment of the invention.

FIG. 15 is a cross-sectional side view illustrating an antenna device according to a third embodiment of the invention.

Figure 16:
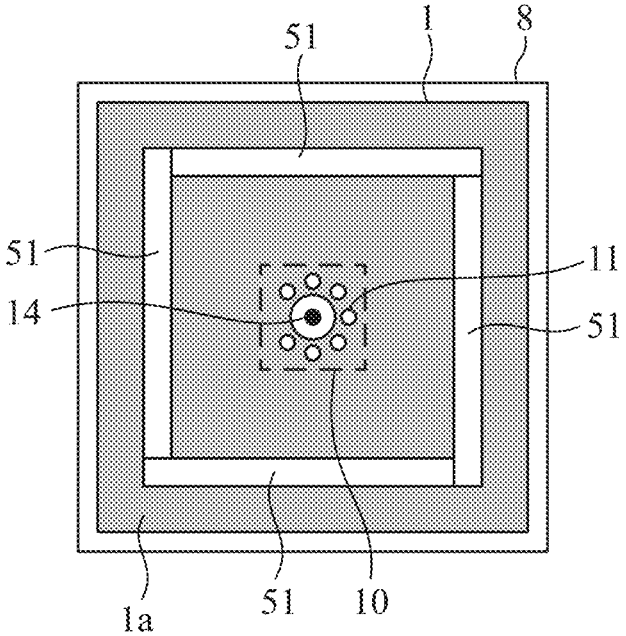
FIG. 16 is a plan view illustrating a top surface of the antenna device according to the third embodiment of the present invention.

FIG. 16 is a plan view illustrating a top surface of the antenna device according to the third embodiment of the present invention.

In FIGS. 15 and 16, the same symbol as that in FIGS. 1 to 3 represents the same or a corresponding part and thus description thereof is omitted.

The third dielectric substrates 51 are dielectric substrates stacked on the first plane 1*a* of the first ground conductor 1 so as to surround a coaxial line 10.

Inside the third dielectric substrates 51, the element antennas 3*a*, 3*b*, 3*c*, and 3*d* are formed.

Also, in the case where the element antennas 3*a*, 3*b*, 3*c*, and 3*d* are formed inside the third dielectric substrates 51, an antenna device that operates in a similar manner to the first embodiment is obtained.

Fourth Embodiment

FIG. 13 of the first embodiment illustrates the antenna device including the fourth ground conductor 41.

Figure 17:
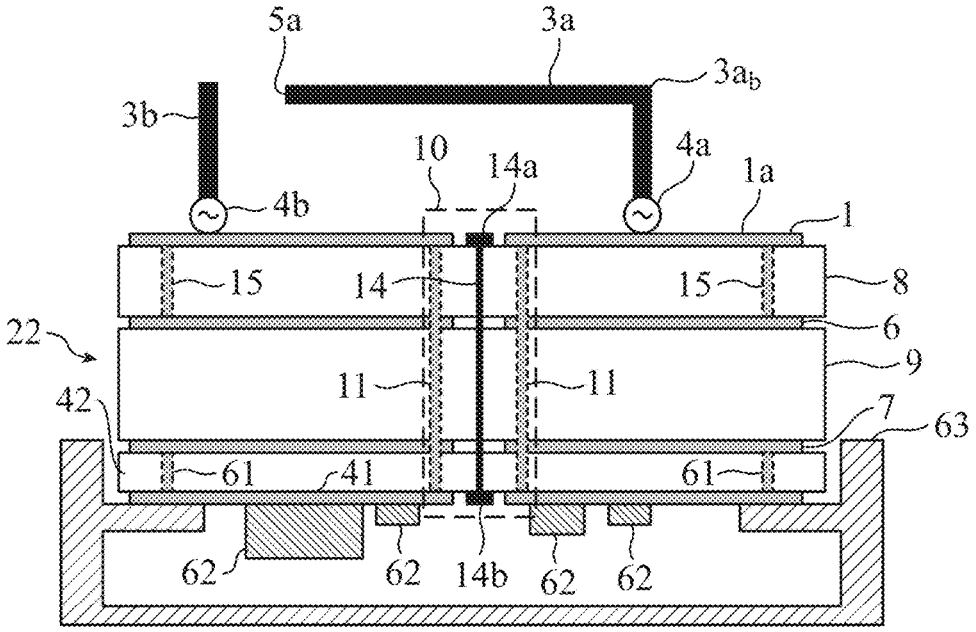
FIG. 17 is a cross-sectional side view illustrating an antenna device according to a fourth embodiment of the invention.

In a fourth embodiment, an antenna device will be described in which communication component circuits 62, including a filter used for suppressing unwanted waves, an amplifier for amplifying a signal or the like when satellite communication is performed for example, are mounted on a fourth ground conductor 41 as illustrated in FIG. 17.

FIG. 17 is a cross-sectional side view illustrating an antenna device according to a fourth embodiment of the invention.

In FIG. 17, the same symbol as that in FIGS. 1 to 3 and 13 represents the same or a corresponding part and thus description thereof is omitted.

Conductive members 61 are provided so as to pass through a third dielectric substrate 42 and allow the third ground conductor 7 and the fourth ground conductor 41 to be conductive therebetween.

The multiple conductive members 61 are arranged at positions surrounding a coaxial line 10 and communication component circuits 62.

The communication component circuits 62 are attached to, out of the two planes of the fourth ground conductor 41, the plane opposite to the plane on which the third ground conductor 7 is arranged, and includes communication components such as filters or amplifiers used for satellite communication, for example.

A first metal housing 63 is connected to the fourth ground conductor 41 so as to shield the communication component circuit 62 from the surroundings thereof.

In the antenna device illustrated in FIG. 17, conductive members 61 allow the third ground conductor 7 and the fourth ground conductor 41 to be conductive therebetween, and the first metal housing 63 protects the communication component circuit 62.

Therefore, even when the antenna device is mounted with the communication component circuits 62, the antenna device itself can operate in a similar manner to the first embodiment.

Fifth Embodiment

In the fourth embodiment, the antenna device including the first metal housing 63 is illustrated.

Figure 18:
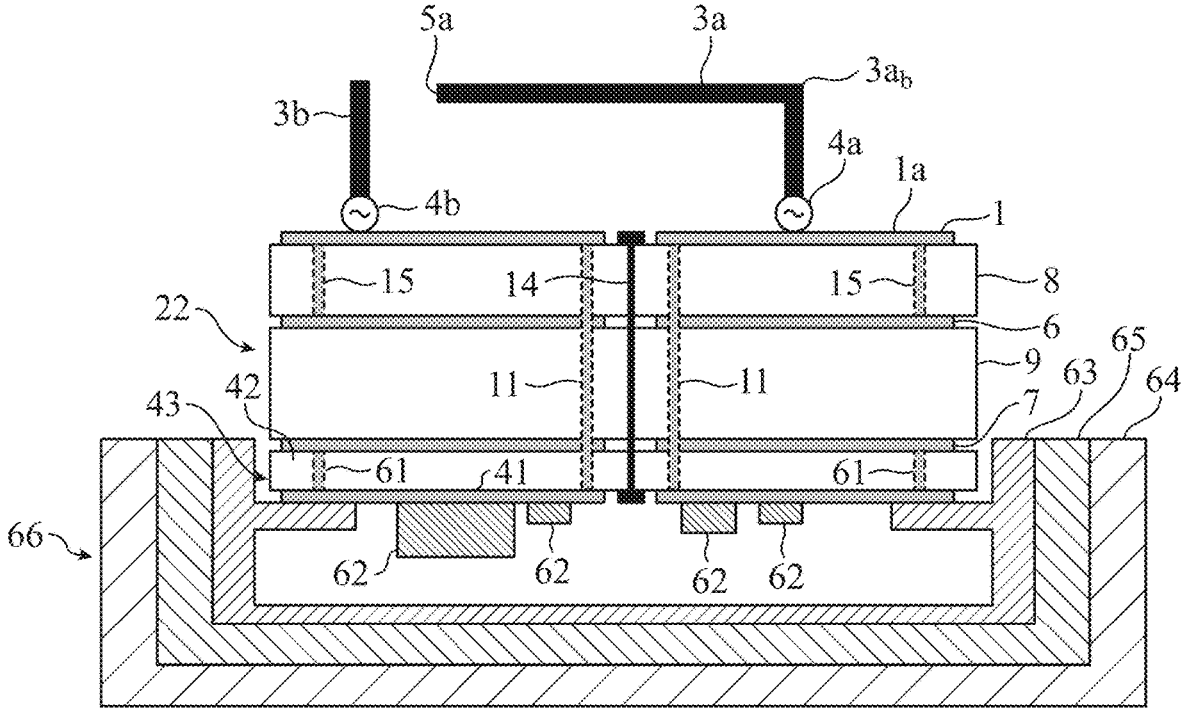
FIG. 18 is a cross-sectional side view illustrating an antenna device according to a fifth embodiment of the invention.

In a fifth embodiment, an antenna device further including a second metal housing 64 as illustrated in FIG. 18 will be described.

FIG. 18 is a cross-sectional side view illustrating the antenna device according to the fifth embodiment of the invention.

In FIG. 18, the same symbol as that in FIGS. 1 to 3 and 17 represents the same or a corresponding part and thus description thereof is omitted.

The second metal housing 64 is arranged so as to surround a first metal housing 63.

A resin member 65 is filled between the first metal housing 63 and the second metal housing 64.

In the antenna device illustrated in FIG. 18, the second metal housing 64 is arranged so as to surround a first metal housing 63, and the space between the first metal housing 63 and the second metal housing 64 is filled with a resin member 65, and thus a microstrip resonator 66 is formed by the first metal housing 63 and the second metal housing 64.

In this case, if the electrical length between the first metal housing 63 and the second metal housing 64 is about half a wavelength at the resonance frequency, the microstrip resonator 66 operates in a similar manner to the microstrip resonator 22.

According to the fifth embodiment, cross polarized waves can be suppressed also by the microstrip resonator 66 formed by the first metal housing 63 and the second metal housing 64.

Note that the present invention may include a flexible combination of the respective embodiments, a modification of any component of the embodiments, or an omission of any component in the embodiments within the scope of the present invention.

INDUSTRIAL APPLICABILITY

The present invention is suitable for an antenna device including a plurality of element antennas.

REFERENCE SIGNS LIST

1: first ground conductor, 1*a*: first plane, 1*b*: second plane, 2: circularly polarized wave transmitting/receiving unit, 3*a*, 3*b*, 3*c*, 3*d*: element antenna, 4*a*, 4*b*, 4*c*, 4*d*: feeding point, 5*a*, 5*b*, 5*c*, 5*d*: tip, 6: second ground conductor, 7: third ground conductor, 8: first dielectric substrate, 9: second dielectric substrate, 10: coaxial line, 11: outer conductor, 12: penetrating member, 13: conductor, 14: inner conductor, 14*a*: one end of inner conductor, 14*b*: the other end of inner conductor, 15: conductive member, 16: penetrating member, 17: conductor, 18: interface circuit, 19: 180-degree hybrid, 20, 21: 90-degree hybrid, 22: microstrip resonator, 30: passive element, 41: fourth ground conductor, 42: third dielectric substrate, 43: microstrip resonator, 51: third dielectric substrate, 61: conductive member, 62: communication component circuit, 63: first metal housing, 64: second metal housing, 65: resin member, 66: microstrip resonator

The invention claimed is:

1. An antenna device comprising:

a first ground conductor having a first plane and a second plane;

a plurality of element antennas arranged on the first plane of the first ground conductor;

a second ground conductor arranged on the second plane of the first ground conductor in parallel with the first ground conductor;

a third ground conductor arranged in parallel to the second ground conductor on, of two planes of the second ground conductor, a plane opposite to the plane on which the first ground conductor is arranged;

a first dielectric substrate arranged between the first ground conductor and the second ground conductor;

a second dielectric substrate arranged between the second ground conductor and the third ground conductor;

a coaxial line provided so as to pass through the second ground conductor and the first and second dielectric substrates, the coaxial line comprising an outer conductor allowing the first ground conductor, the second ground conductor, and the third ground conductor to be conductive thereamong;

a conductive member provided so as to pass through the first dielectric substrate, the conductive member allowing the first ground conductor and the second ground conductor to be conductive therebetween; and an interface circuit to combine a plurality of signals having mutually different phases output from each of the plurality of element antennas and output the combined signal to the coaxial line, wherein each of the plurality of element antennas has a bended point from which each of the plurality of element antennas extends in a direction parallel to the first ground conductor, and the direction is different among each of the plurality of element antennas.

2. The antenna device according to claim 1, wherein the interface circuit divides a signal transmitted by the coaxial line into a plurality of signals having mutually different phases and outputs each of the divided multiple signals to the plurality of element antennas.

3. The antenna device according to claim 1, wherein the outer conductor in the coaxial line comprises:

a plurality of penetrating members each having one end connected to the second plane of the first ground conductor at a position surrounded by feeding points of the plurality of element antennas; and a plurality of conductors each inserted in one of the plurality of penetrating members, the plurality of conductors allowing the first ground conductor, the second ground conductor, and the third ground conductor to be conductive thereamong, and the coaxial line comprises the outer conductor and an inner conductor arranged at a position surrounded by the plurality of penetrating members.

4. The antenna device according to claim 1, wherein the first to third ground conductors are flat plates having square planar shapes, a length of each side of the second ground conductor is equal to a length of half a wavelength at a resonance frequency of the plurality of element antennas, and a length of each side of the third ground conductor is longer than or equal to the length of half the wavelength at the resonance frequency of the plurality of element antennas.

5. The antenna device according to claim 1, wherein the first ground conductor is a flat plate having a square planar shape, four element antennas are arranged on the first plane of the first ground conductor as the plurality of element antennas, each of the four element antennas is an inverted L antenna having a bended point between a feeding point and a tip, and in the four element antennas, each of tip portions extending from the bended points to the tips is parallel to the first plane of the first ground conductor, and directions from the bended points to the tips are different from each other by 90 degrees and are parallel to any one of sides of the first ground conductor.

6. The antenna device according to claim 1, wherein the first ground conductor is a flat plate having a square planar shape, four element antennas are arranged on the first plane of the first ground conductor as the plurality of element antennas, each of the four element antennas is an inverted F antenna having a feeding point and a connection point with the first plane of the first ground conductor, and in the four element antennas, each of tip portions extending from bended points between the feeding points and tips to the tips is parallel to the first plane of the first ground conductor, and directions from the bended points to the tips are different from each other by 90 degrees and are parallel to any one of sides of the first ground conductor.

7. The antenna device according to claim 1, wherein the first ground conductor is a flat plate having a square planar shape, four element antennas are arranged on the first plane of the first ground conductor as the plurality of element antennas, each of the four element antennas is a folded monopole antenna having a feeding point and a connection point with the first plane of the first ground conductor, and in the four element antennas, each of portions extending from bended points between the feeding points and folded points to the folded points is parallel to the first plane of the first ground conductor, and directions from the bended points to the folded points are different from each other by 90 degrees and are parallel to any one of sides of the first ground conductor.

8. The antenna device according to claim 1, wherein a passive element corresponding to each of the plurality of element antennas is arranged on the first plane of the first ground conductor.

9. The antenna device according to claim 1, wherein each of four sides of the second ground conductor having a square planar shape is notched.

10. The antenna device according to claim 1, further comprising:

a third dielectric substrate arranged on the first plane of the first ground conductor, wherein the plurality of element antennas is formed in the third dielectric substrate.

11. The antenna device according to claim 1, comprising:

a fourth ground conductor arranged in parallel with the third ground conductor on, of two planes of the third ground conductor, a plane opposite to the plane on the side on which the second ground conductor is arranged;

a communication component circuit attached to, of two planes of the fourth ground conductor, a plane opposite to the plane on which the third ground conductor is arranged; and a first metal housing shielding the communication component circuit from surroundings thereof.

12. The antenna device according to claim 11, further comprising:

a second metal housing arranged so as to surround the first metal housing, wherein a space between the first metal housing and the second metal housing is filled with a resin member.

* * * * *